US007287471B2

(12) United States Patent
Graeler et al.

(10) Patent No.: US 7,287,471 B2
(45) Date of Patent: Oct. 30, 2007

(54) INK RESERVOIR DOCTOR BLADE

(75) Inventors: Klaus Graeler, Lengerich (DE); Guenter Rogge, Lienen (DE)

(73) Assignee: Windmoeller & Hoelscher KG, Lengerich (DE)

( * ) Notice: Subject to any disclaimer, the term of this patent is extended or adjusted under 35 U.S.C. 154(b) by 0 days.

(21) Appl. No.: 10/529,554

(22) PCT Filed: Nov. 26, 2003

(86) PCT No.: PCT/EP03/13347

§ 371 (c)(1),
(2), (4) Date: Mar. 29, 2005

(87) PCT Pub. No.: WO2004/048097

PCT Pub. Date: Jun. 10, 2004

(65) Prior Publication Data

US 2006/0027112 A1 Feb. 9, 2006

(30) Foreign Application Priority Data

Nov. 28, 2002 (DE) ..... 102 55 411

(51) Int. Cl.
*B41F 31/04* (2006.01)

(52) U.S. Cl. ..... 101/350.6; 101/363; 101/169

(58) Field of Classification Search ..... 101/350.6, 101/157, 169, 363, 364, 365
See application file for complete search history.

(56) References Cited

U.S. PATENT DOCUMENTS

| | | | | |
|---|---|---|---|---|
| 5,400,710 | A | 3/1995 | Ehrhard | |
| 5,517,918 | A * | 5/1996 | Van Denend | 101/363 |
| 5,735,210 | A * | 4/1998 | Rogge et al. | 101/366 |
| 6,202,252 | B1 * | 3/2001 | Harrisson | 15/256.51 |
| 6,637,330 | B1 * | 10/2003 | Nordby et al. | 101/350.6 |
| 6,792,855 | B2 * | 9/2004 | Pertile | 101/350.6 |
| 2003/0051619 | A1 * | 3/2003 | Rogge | 101/350.6 |

FOREIGN PATENT DOCUMENTS

| | | |
|---|---|---|
| DE | 42 41 792 A1 | 6/1994 |
| DE | 43 20 833 C1 | 9/1994 |
| WO | WO 00/78548 A1 | 12/2000 |

* cited by examiner

*Primary Examiner*—Leslie J. Evanisko
(74) *Attorney, Agent, or Firm*—Jacobson Holman PLLC

(57) ABSTRACT

A color chamber doctor blade has two doctor blade knives oriented in a roof-like fashion against a roller, from which the two doctor blade knives can be fixed on a doctor blade chamber body by means of a clamping plate. The clamping plate is in active connection with long-stretch fasteners in the axial direction (z) of the roller. The long-stretch fasteners are arranged substantially parallel to the clamping plate, and apply the force required for fixing at least one doctor blade knife. The resultant of the force exercised by the fasteners points toward the doctor blade chamber body.

14 Claims, 2 Drawing Sheets

INK RESERVOIR DOCTOR BLADE

This is a nationalization of PCT/EPO3/013347 filed Nov. 26, 2003 and published in German.

BACKGROUND OF THE INVENTION

1. Field of Invention

The invention relates to a color chamber doctor blade.

2. Description of the Prior Art

Color chamber doctor blades have been known for a long time. The color chamber doctor blades are subject to continuous wear and therefore must be replaced regularly. As a rule, to fix them, the doctor blade knives are pressed against the doctor blade chamber body with the help of a clamping plate. For that purpose, in the past, the clamping plates were fixed with screws on the doctor blade chamber body, as shown in DE 42 41 792 A1. The clamping plate, in its turn, presses the doctor blade knife against the doctor blade chamber body and thus fixes it. However, because of the length of the doctor blade in the radial direction of the roller, which is impinged with color from the doctor blade chamber, a large number of screws must be changed when changing the doctor blades. Since all kinds of set-up times lead to machine still stand and, as a result, are expensive, various suggestions for devices have been made in the literature that permit faster exchange of the doctor blade knives. Thus, in DE 43 20 833 C1S use of rapid-action locking devices is suggested. In recent times, one finds that the aforementioned types of fixing the clamping plates of the doctor blade knives on the doctor blade chamber body are being replaced, such that

- the clamping plate is in active connection with long-stretch fasteners in the axial direction (z) of the roller,
- which are mounted essentially parallel to the clamping plate
- and by which the force necessary for fixing at least one of the doctor blade knives is exercised, Clamping plates are flexible sheet metal plates that are held by means of screws or similar means of fastening on the doctor blade chamber body, however, they are not permanently fixed. Clamping is done on the side of the screws facing the roller, whereby the long-stretch fasteners in the axial direction (z) of the roller exert force on the clamping plate, which points away from the doctor blade chamber body. The clamping plate is, however, fixed on the doctor blade chamber body by the screws, so that the clamping plate buckles and exerts force on the doctor blade knife, on the side of the screws facing the roller, which is mounted on the doctor blade chamber body and thus fixes the doctor blade knife on the doctor blade chamber body. If the force exerted by the long-stretch fasteners is inhibited, force is also neither exerted on the doctor blade knife and, if applicable, on the clamping plate.

In general, the long-stretch fasteners in the axial direction (z) of the roller are rods, with a partially round cross section, which are supported rotatably in the doctor blade chamber body. Such rods are then provided with a recess or a projection, which leads to it that, on rotation of the rod, a force is exerted, whose resultant points away from the doctor blade chamber. However, it is also possible to place an inflatable hose or an another body at that point, which can increase its volume, and in that way, exert a force on the clamping plate, whose resultant points away from the doctor blade chamber body.

Finally it should be emphasized again that the major advantage of this type of fastening is that, compared to the fixing of the doctor blade knife by loosening screws, significantly lesser number of objects of fastening—such as the rod for instance—need to be handled, so that it leads to significant saving of time in the changeover of the knives.

However, the described fastening systems also have their disadvantages.

As it is apparent from the above explanation and the following description of the situation, a large number of screws or similar fasteners must be pushed at least through the clamping plate for the above mentioned prefixing of the clamping plates. Therefore, the described doctor blade chambers have a number of holes and juts (screws) in the area of the clamping plates. Naturally, due to the unavoidable mass of the residues of the color exiting from the color deck, color deposits precipitate precisely on the holes and the juts (screws), which make it difficult to cleanse the machine and, to some extent, also to change the knives.

Consequently, the task of the present invention is to devise a doctor blade chamber, which can function with a lesser number of holes and juts (screws) in the area of the clamping plates.

SUMMARY OF THE INVENTION

This task is solved, in that

- the resultant force exercised by the fasteners points to the doctor blade chamber body.

This measure makes the supporting function for holding the screws as implemented in the current status of the technology superfluous. The result is that the holes in the clamping plate and the juts (screws) protruding from the clamping plate are no longer necessary. Further, there are less impurities in the area of the clamping plate. In addition to that, one can dispense with the use of the spring steel sheet used in the fabrication of the clamping plates, since the pressing force necessary for fixing the doctor blade knife and its restoring force do not result from the buckling of the sheet metal plate, but ensue directly from the fasteners.

Further advantages and embodiments of the invention follow from the description of the concrete situation and the claims.

DETAILED DESCRIPTION OF THE PREFERRED EMBODIMENTS

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

Figure 1:
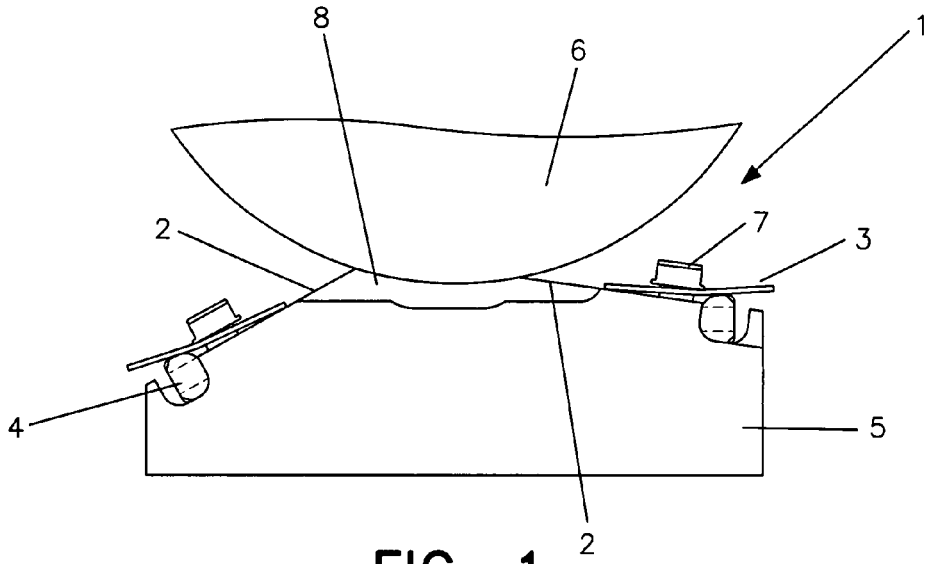
FIG. 1 PRIOR ART
FIG. 1. A section of a doctor blade chamber in operation according to the current status of the technology FIG. 2. A section of a doctor blade chamber taken out from the roller according to current status of technology FIG. 3. Top view of a clamping plate according to the current status of the technology FIG. 4. A section of a doctor blade chamber in operation according to the invention FIG. 5. A section of a doctor blade chamber taken out from the roller according to the invention FIG. 6. An enlarged view of a cross section of the rod 4 scope of the invention will become apparent to those skilled in the art from this detailed description.

FIG. 1 shows a color chamber doctor blade 1 according to the current status of the technology. As is known, in case of the color chamber doctor blades 1, the color chamber 8 is limited by the roller 6 to be colored of the doctor blade chamber body 5, whereby 5 can obviously also consist of several parts, and the doctor blade knives 2. As adequately detailed in the introductory description, the two doctor blade knives 2 of the color chamber doctor blades 1 are each fixed by means of a clamping plate 3, which presses the respective doctor blade knives 2 against the doctor blade chamber body 5. The force required for this is the restoring force of the clamping plate, which arises, because the clamping plate is buckled between the long-stretch fastening element 4, which is represented in this case by the rod, and the head of the screw 7 and the doctor blade chamber body 5.

Figure 2:
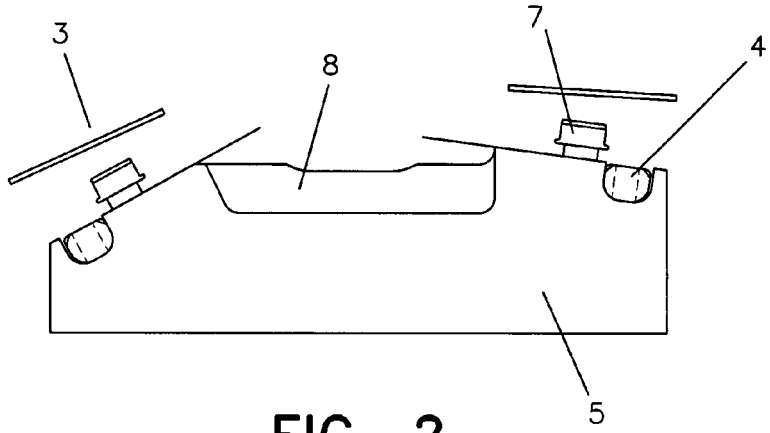
FIG. 2 PRIOR ART

As already mentioned, the resultant force, which the rod 4 exerts on the clamping plate, points away from the doctor blade chamber. This force arises because the rod 4 is provided with a recess that is at the same level with the surface of the doctor blade chamber body 5 during the loading of the clamping plate 3 as shown in FIG. 2. Thus the rotation of the rod 4 brings the circular part of the peripheral area of the mainly cylindrically shaped rod 4 in contact with the clamping plate 3, the contacted part of the clamping plate is pressed outside and the previously described restoring force of the plate 3 fixes the doctor blade knife.

Figure 3:
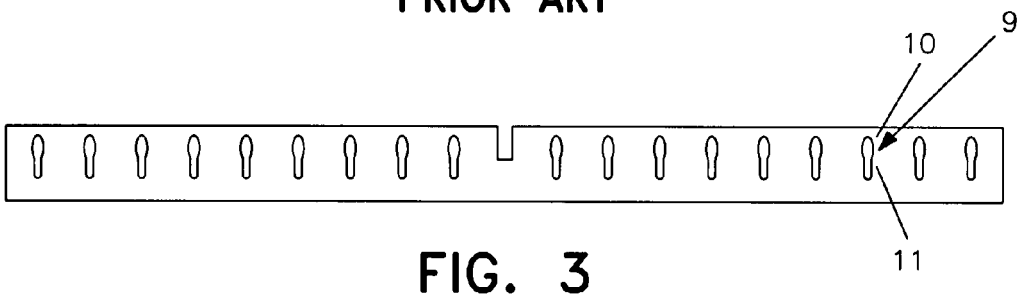
FIG. 3 PRIOR ART

FIG. 3 shows a clamping plate, which is suitable for use in the doctor blade chamber shown in FIGS. 1 and 2.

The round holes 10 and the slots 11 form the openings 9. Thereby, the diameter of the holes 10, together with the necessary play, is matched with the head of the screw 7, while the width of the slot 11 is matched to the diameter of the neck of the screws. If the clamping plate is to be removed from its operating position, the clamping plate is at first loosened by turning the rod 4 in such a fashion that the recess comes in contact with the plate 3. Since no force or lateral buckling action on the clamping plate 4 ensues from the rod 4 now, it is held only loosely by the screws 7. As a result, the plate is brought from its operating position, in which the necks of the screws grip through the grooves 11, into the removal position, thus enabling the heads of the screws 7 to slide out through the holes 10 of the clamping plate 3 for the removal.

Figure 4:
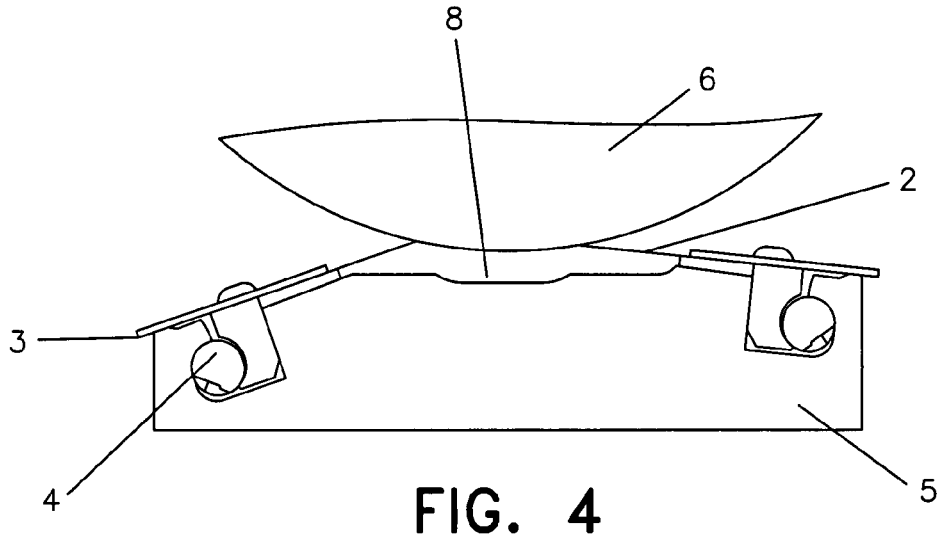
Figure 5:
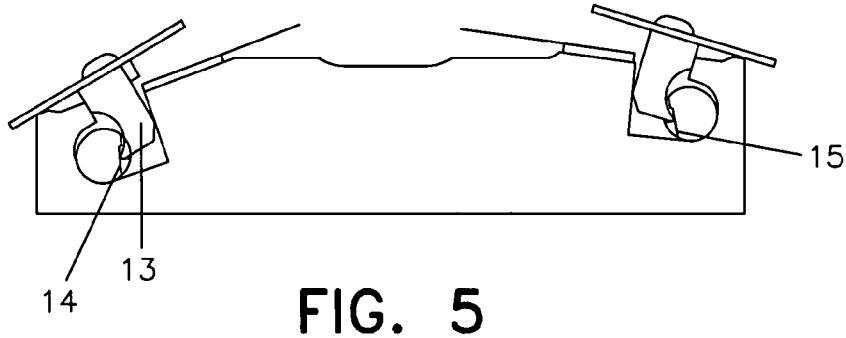

FIGS. 4 and 5 show a chamber doctor blade according to the invention, in which the clamping plates 3 are provided with a top piece 13, which includes a joining element 14. The joining element is matched according to the recess 15 of the rod 4. The form of the recess 15 is shown once again in FIG. 6. While mounting the clamping plate 3 and the top piece 13, the joining element slides along the surface 18 of the rod 4. On striking the joining element on the recess 15 of the rod 4, the rod 4 can be turned into the clamping position. After loading the knife, the knife is clamped by rotating the rod 4. When rotating the rod 4 into the closing direction, first the joining element slides along the even surface 18 of the recess 15, to be subsequently carried along by the shoulder 17 of the recess. The unit consisting of the top piece 13 and the clamping plate 3 is thus brought into the position suitable for fixing the doctor blade knife 2.

Figure 6:
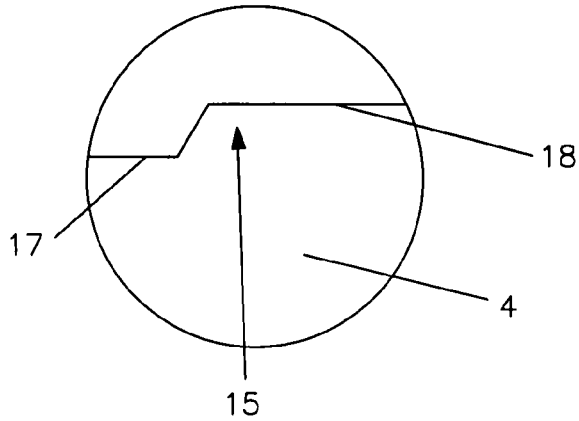

FIG. 6 shows the top view of the clamping plate 3 which is used in the chamber doctor blades according to the invention shown in FIGS. 4 and 5.

The invention being thus described, it will be apparent that the same may be varied in many ways. Such variations are not to be regarded as a departure from the spirit and scope of the invention, and all such modifications as would be recognized by one skilled in the art are intended to be included within the scope of the following claims.

| List of Reference Symbols | |
|---|---|
| 1 | Color chamber doctor blade |
| 2 | Doctor blade knife |
| 3 | Clamping plate |
| 4 | Fastening element |
| 5 | Color chamber body |
| 6 | Roller |
| 7 | Screw |
| 8 | Color chamber |
| 9 | Opening |
| 10 | Hole |
| 11 | Slot |
| 12 | |
| 13 | Top piece |
| 14 | Joining element |
| 15 | Recess |
| 16 | Recess |
| 17 | Shoulder |
| 18 | Area |
| 19 | Arrow |

What is claimed is:

1. Color chamber doctor blade with two doctor blade knives that can be set up in roof-like fashion against a roller from which both the doctor blade knives can be fixed on a doctor blade chamber body by a clamping plate having a top piece and the clamping plate is in active connection with long fasteners stretching in an axial direction of the roller, which are arranged essentially parallel to the clamping plate and from which the force required for fixing at least one of the doctor blade knives is applied, characterized in that a resultant of the forces applied by the long fasteners points to the doctor blade chamber body, and the long fasteners include at least one rod having an essentially round cross sectional area and a recess suitable for clamping the clamping plate or the top piece.

2. Color chamber doctor blade according to claim 1, characterized in that the top piece of the clamping plate is specially shaped such that the top piece forms an active connection with the long fasteners in the axial direction of the roller.

3. Color chamber doctor blade according to claim 1, characterized in that through the movement of the rod relative to the color chamber doctor blade, the force required for fixing at least one of the doctor blade knives is provided.

4. Color chamber doctor blade according to claim 3, characterized in that the relative movement of the rod consists of a rotation around its principal axis of inertia.

5. Color chamber doctor blade according to claim 1, characterized in that the rod is fixed rotatably in the doctor blade chamber body.

6. Color chamber doctor blade according to claim 5, characterized in that the top piece has a joining element, which can be inserted into the recess of the cross sectional area of the rod.

7. Color chamber doctor blade according to claim 6, characterized in that the length of the top piece, the position of the joining element on the top piece and the positions of the rod and the recess are adjusted with each other in such a way that the joining element of the clamping plate located outside the doctor blade chamber can be inserted in a form-fitting manner into the recess at the beginning of the process of fixing of the doctor blade knife and that the rotation of the rod required for fixing the doctor blade knife conveys the joining element and the clamping plate into the position suitable for fixing.

8. A color chamber doctor blade comprising:

a doctor blade knife oriented at an angle against a roller;

a clamping plate for fixing the doctor blade knife to a doctor blade chamber body, the clamping plate including a top piece with a clamp; and a fastener for applying a force that enables the clamping plate to fix the doctor blade knife, the fastener being a rotatable rod that is oriented in an axial direction of the roller and substantially parallel to the clamping plate and that has a recess for communicating with the clamp such that a resultant of the force applied by the fastener points from the clamping plate toward the doctor blade chamber body.

9. The color chamber doctor blade according to claim 8, wherein the recess includes a surface along which the clamp slides, and a shoulder for engaging the clamp so as to provide the force that enables the clamping plate to fix the doctor blade knife.

10. The color chamber doctor blade according to claim 8, wherein through rotation of the rod, the clamp engages the rod recess and provides the force that enables the clamping plate to fix the doctor blade knife.

11. The color chamber doctor blade according to claim 8, wherein the fastener is rotatably housed in the doctor blade chamber body.

12. A color chamber doctor blade comprising:

a doctor blade knife oriented at an angle against a roller;

a clamping plate for fixing the doctor blade knife to a doctor blade chamber body, the clamping plate including a top piece with a clamp; and a rotatable fastener for applying a force that enables the clamping plate to fix the doctor blade knife, the fastener being oriented in an axial direction of the roller and substantially parallel to the clamping plate and having a recessed surface with a shoulder for communicating with the clamp, such that upon rotation of the fastener in a first direction, the clamp engages the shoulder so as to provide the force that enables the clamping plate to fix the doctor blade knife.

13. The color chamber doctor blade according to claim 12, wherein a resultant of the force applied by the fastener points from the clamping plate toward the doctor blade chamber body.

14. The color chamber doctor blade according to claim 12, wherein the fastener is rotatable in a direction opposite to the first direction such that the clamp disengages from the shoulder and enables the clamping plate to release the doctor blade knife.

* * * * *